US006425702B1

(12) United States Patent
Brunetti

(10) Patent No.: US 6,425,702 B1
(45) Date of Patent: Jul. 30, 2002

(54) MULTI-COLOR PEN SYSTEM

(75) Inventor: Bruce W. Brunetti, Phillipsburg, NJ (US)

(73) Assignee: Chartpak, Inc., Leeds, MA (US)

( * ) Notice: Subject to any disclaimer, the term of this patent is extended or adjusted under 35 U.S.C. 154(b) by 0 days.

(21) Appl. No.: 09/712,793

(22) Filed: Nov. 14, 2000

(51) Int. Cl.[7] ..... A43K 23/00
(52) U.S. Cl. ..... 401/16; 401/88
(58) Field of Search ..... 401/16–20, 48, 401/88, 131

(56) References Cited

U.S. PATENT DOCUMENTS

| | | | | | |
|---|---|---|---|---|---|
| 368,517 | A | * | 8/1887 | Cornwall | 401/88 |
| 877,370 | A | * | 1/1908 | Reckendorfer | 401/88 |
| 1,568,347 | A | * | 1/1926 | Shaw | 401/48 |
| 1,647,536 | A | * | 11/1927 | Miller | 401/88 |
| 1,820,782 | A | * | 8/1931 | Climenson | 401/131 |
| D136,074 | S | | 7/1943 | Morris | |
| 3,638,319 | A | * | 2/1972 | Barlow et al. | 401/88 |
| 3,947,137 | A | | 3/1976 | Hori | |
| 3,951,555 | A | | 4/1976 | Wittnebert et al. | |
| 4,016,982 | A | * | 4/1977 | Schreiber | 401/131 |
| 4,030,841 | A | * | 6/1977 | Balasty | 401/88 |
| 4,239,408 | A | | 12/1980 | Mutschler | |
| D281,512 | S | | 11/1985 | Kobori | |
| 4,671,692 | A | | 6/1987 | Inaba | |
| 4,712,937 | A | | 12/1987 | Schmidt et al. | |
| D332,626 | S | | 1/1993 | Wada et al. | |
| 5,336,009 | A | | 8/1994 | Young | |
| 5,829,904 | A | | 11/1998 | Matsumoto et al. | |
| 5,927,886 | A | | 7/1999 | Matsumoto | |
| 5,938,362 | A | | 8/1999 | Bastiansen | |
| 5,951,183 | A | * | 9/1999 | Landis | 401/48 |
| 6,062,758 | A | | 5/2000 | Maurer et al. | |

FOREIGN PATENT DOCUMENTS

| | | | | | |
|---|---|---|---|---|---|
| FR | 468774 | A | * | 7/1914 | 401/88 |
| GB | 103966 | A | * | 2/1917 | 401/131 |

* cited by examiner

*Primary Examiner*—Charles R. Eloshway
(74) *Attorney, Agent, or Firm*—Schweitzer Cornman Gross & Bondell LLP

(57) ABSTRACT

A multi-color pen system is provided in which there are a plurality of liquid ink pen units, each of a different color. Each unit includes a nib and writing point, a collector element providing capillary passages for air and ink, and a tubular receiving body which houses the collector and forms an ink reservoir above the collector. Each unit is a complete, functioning pen device. The receiving body of each unit is threaded to receive a detachable pen holder to facilitate gripping the pen during use.

6 Claims, 3 Drawing Sheets

MULTI-COLOR PEN SYSTEM

BACKGROUND OF THE INVENTION

The present invention relates to colored ink pens and more particularly to kits or systems, used typically by artists and the like, consisting of a plurality of pens of different colors for selective use by the artist. The invention is directed to improvements in such multi-color pen systems also providing for desirable economies of manufacture while providing certain conveniences of storage and use.

SUMMARY OF THE INVENTION

In a liquid ink pen of the type contemplated, a pen unit houses a reservoir for liquid ink and utilizes a capillary system for feeding ink to the writing point while enabling the reservoir to "breathe" in necessary ways. For example, as ink is used in the reservoir, air must be admitted to prevent formation of a vacuum. In addition, changes in temperature cause volume fluctuations in the air and liquid in the ink reservoir, which are accommodated by the capillary system. The relevant principles are well known and are described in, for example, the Wittnebert U.S. Pat. No. 3,951,555.

In accordance with the present invention, a multi-color pen system is provided in which there are multiple independent liquid ink pen units, each a complete, functioning pen which is of minimal structure comprising a nib and collector cartridge and a tubular receiving body. The collector element is received in an open lower end of the receiving body, and the upper portion of the receiving body, above the collector, forms an ink reservoir. The receiving body is a simple plastic molding, which is designed to be almost exclusively functional, without regard to appearance or other factors.

In conjunction with the plurality of pen units, the invention contemplates the use of a single tubular pen holder which attaches to the upper portion of the receiving body by means of screw threads or the like. Within the contemplation of the invention, of course, there could be more than one pen holder, but the invention contemplates that there should normally be only one and in any case significantly fewer pen holders than pen units.

Pursuant to a preferred embodiment of the invention, the tubular receiving body has a stepped configuration, being of somewhat greater diameter in its lower portion than in its upper portion. The somewhat larger lower portion receives the collector element and by that means mounts the nib and writing point at the forward end of the receiving body. An external connecting means is provided on the receiving body, with screw threads or the like to detachably engage a holder element. The holder element is arranged to be received over the upper portion of the receiving body to provide a comfortable grip for the pen. Preferably, the receiving body extends below the connector means such that the lower portion of the receiving body forms, in effect, an extension of the holder.

For a more complete understanding of the above and other features and advantages of the invention, reference should be made to the following detailed description of preferred embodiments of the invention and to the accompanying drawings.

DESCRIPTION OF THE PREFERRED EMBODIMENTS

Figure 1:
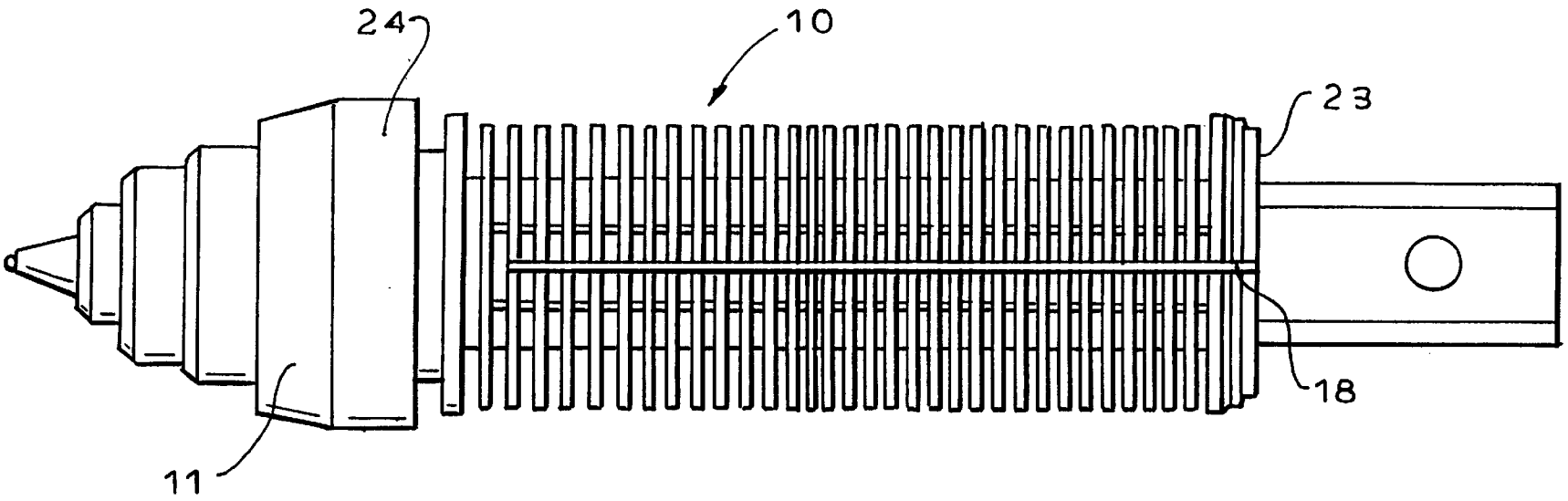
FIG. 1 is an elevational view of a combination nib and collector cartridge of a type suitable for use in the invention.
Figure 2:
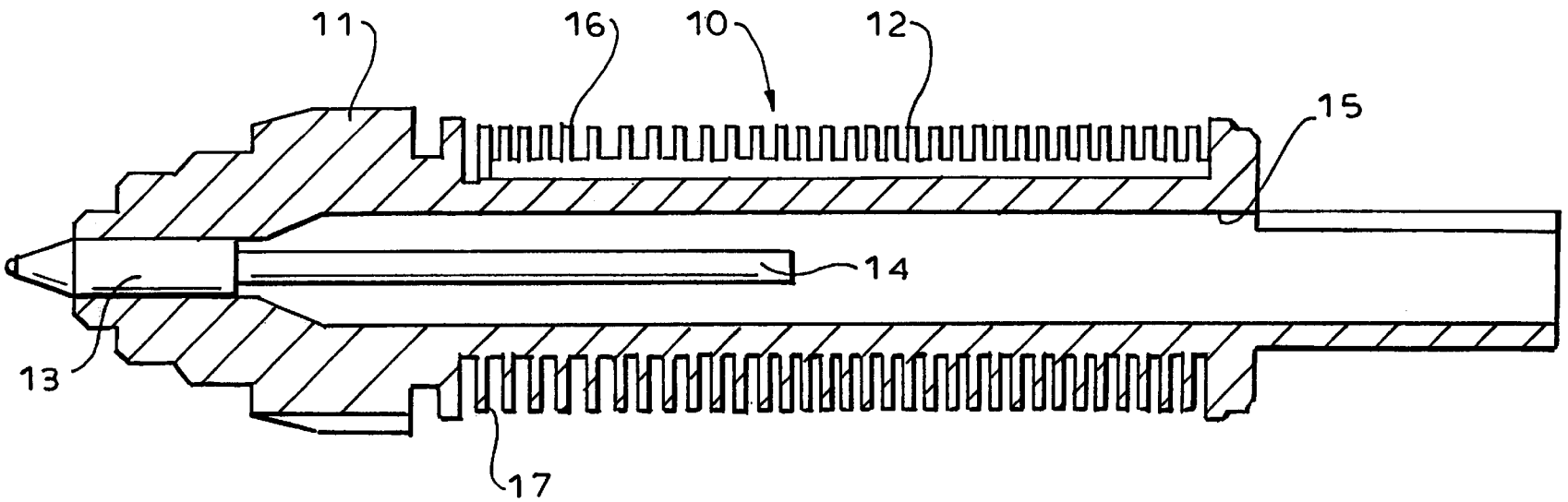
FIG. 2 is a longitudinal cross sectional view of the cartridge of FIG. 1.

Referring now to the drawing, FIGS. 1 and 2, illustrate a combination nib and collector cartridge 10, which preferably is a unitary plastic molding defining a nib 11 and collector 12. The nib mounts a writing point 13 including a capillary element 14 extending longitudinally into an internal passage 15 in the cartridge. The collector unit, in accordance with known principles, comprises a plurality of disc-like lamellae 16 forming annular capillary spaces. Along one side of the lamellae 16 there is an air passage formed by notches 17. On the opposite side, there is a capillary slot 18, which extends from the upper end of the collector through all of the lamellae except the last (i.e., lowermost) one.

Figure 3:
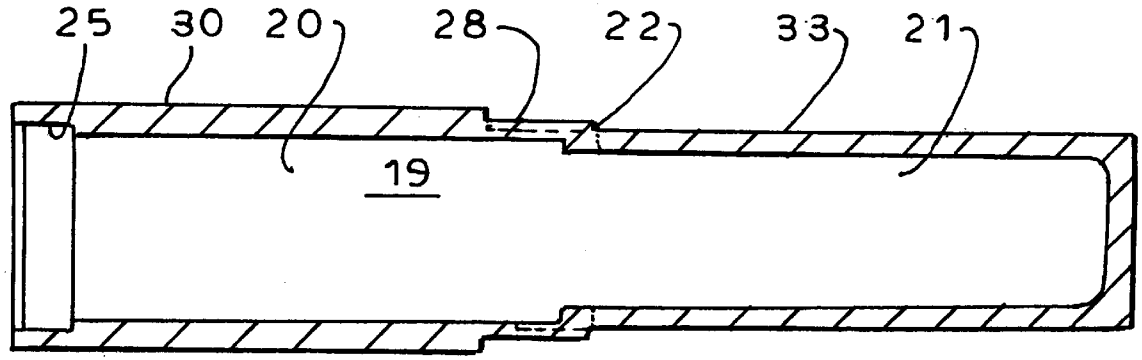
FIG. 3 is a longitudinal cross sectional view of a receiving body which receives the collector portion of the cartridge of FIG. 1 and forms therewith a liquid ink reservoir.
Figure 4:
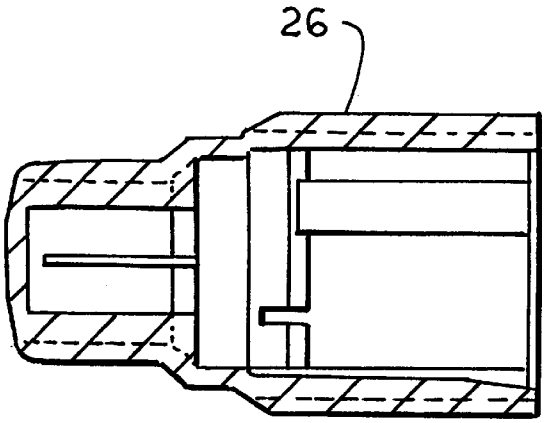
FIG. 4 is a longitudinal cross sectional view of a cap which can be applied over the lower end of the receiving body of FIG. 3 for sealing a pen unit when not in use.

Pursuant to the invention, the cartridge 10 is mounted in a receiving body 19, shown in FIG. 3. The receiving body comprises an open-ended lower portion 20 and a closed upper portion 21. The lower portion 20 is slightly greater in diameter than the upper portion and forms an internal shoulder 22. An upper flange 23 provided on the cartridge 10 seats against this shoulder when the cartridge is inserted into the receiving body. The flange 23 forms a tight fit with the internal walls of the chamber 20, forming a working seal at the bottom of the upper chamber 21, which serves an ink reservoir.

When the cartridge 10 is seated within the receiving body 19, the upper flange 23 of the cartridge is tightly seated against the shoulder 22 and a forward or lower flange 24 of the cartridge is seated within a recess 25 at the front or lower end of the receiving body. Typically, this is a permanent assembly.

With the cartridge 10 installed, and the ink reservoir chamber 21 filled with ink, a fully working pen unit is formed. It is contemplated by the invention that a plurality of such pen units will be provided in a single kit, each with its own color of ink. Typically and advantageously, the nib 11 of each pen unit is colored to identify the color of ink within the reservoir of the unit.

Typically, a removable sealing cap 26 is provided for each pen unit suitable to be applied with a friction fit over the lower end of the receiving body to seal the unit when not in use.

Figure 5:
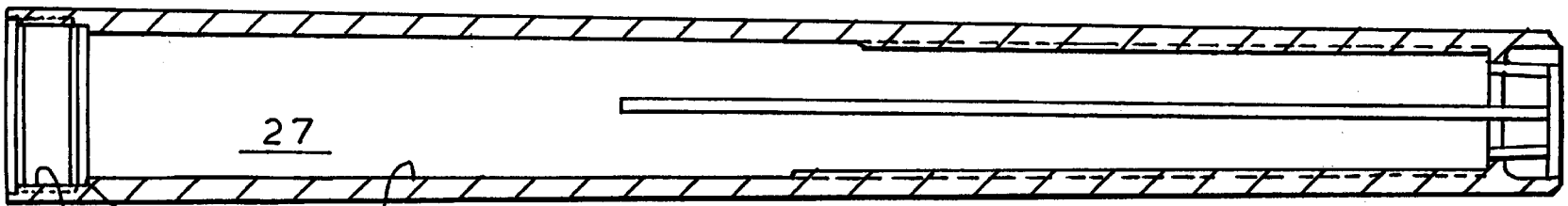
FIG. 5 is a longitudinal cross sectional view of a tubular holder element that is detachably connectable to any of a plurality of pen units to provide more convenient holding and gripping of the pen unit during use.

Pursuant to the invention, a pen holder element 27 is provided, as shown in FIG. 5, for detachable connection to each of the multiple pen units of a kit. In this respect, while each of the individual pen units, comprising the nib-collector cartridge 10 and receiving body 19, is a fully functioning pen, and can be used for writing or sketching, the individual pen units have an overall length of only about 2 ½ inches, and thus are not of a convenient size for comfortable use over a period of time. With a detachable pen holder 27 of 3.6 inches or so in length, the overall length of the device is increased to 4 ½ to 5 inches, a convenient and typical size for such pens.

In accordance with the invention, the receiving body 19 is provided intermediate its ends with an externally threaded portion 28 arranged for detachable connection to an internally threaded end portion 29 of the holder 27. It will be understood, of course, that the detachable connection means need not be mutually engaging threads. Other types of engagement means could well be employed, such as bayonet fastening means, snap-on, snap-off detent arrangements, friction fit, etc. The main concepts of the invention are satisfied as long as the holder 27 is reliably and detachably mountable on and demountable from the pen unit without difficulty.

In a preferred embodiment of the invention, the outside diameter of the lower wall 30 of the receiving body is substantially the same as the outside diameter of the pen holder (e.g., 0.455 inches), in the lower regions 31 thereof adjacent to the internal threaded portion 29. The inside diameter of the holder 27, at least in the lower portions 32 of, the holder, is equal or larger than the outside diameter of the walls 33 of the upper portion of the receiving body. Accordingly, when the holder is applied over the receiving body 19, and the threaded portions 28, 29 are properly engaged, the outer walls 30 of the receiving body will form in effect a continuation of the outer walls of the holder 27.

In a kit consisting of a plurality of pen units 10, 19, only one, or at least only a few, holders 27 need be provided. As the user works successively with pens of different color, the holder 27 can easily be detached from one pen unit and assembled with another with a few twists of the holder device.

The requirement for only a single holder element in a kit or system comprised of a substantial plurality of differently colored pen units provides for significant economies of manufacture, as will be readily apparent. Additionally, the packaging and storing of the small, individual pen units 10, 19 requires considerably less space and a considerably smaller container than if each pen were a full sized device.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A multicolor pen kit which comprises (a) a plurality of liquid ink pen units, each such unit comprising (i) a nib and writing point, (ii) a collector element comprising a plurality of closely spaced lamellae attached to said nib and providing an ink passage to said writing point, (iii) a tubular receiving body mounting said nib and enclosing said collector element to provide capillary paths for ink and air, (iv) said receiving body having an open lower end and a closed upper end and having a first chamber adjacent said open end closely receiving said collector element, and a second chamber adjacent to said closed end forming an ink reservoir between said collector element and said closed end, (v) said receiving body being provided between its ends with external connecting means for the detachable engagement of a pen holder, and (b) at least one tubular pen holder having an open end and being provided with internal connecting means adjacent said open end for detachable engagement with said external connecting means, whereby any of said plurality of pen units can be selectively engaged with said holder, whereby when said pen holder is attached to a pen unit, outer surfaces of said receiving body and said pen holder form a relatively smooth, continuous surface along substantially the entire combined length of the holder and the pen unit (c) there being fever pen holders than pen units in said kit.

2. A multicolor pen kit according to claim 1, wherein (a) lower portions of said receiving body are of a first diameter, (b) upper portions of said receiving body are of a second diameter smaller than said first diameter, and (c) said external connecting means is located in said upper portions.

3. A multicolor pen kit according to claim 2, wherein (a) said receiving body, in a lower region thereof below said external connecting means, has an outside diameter substantially equal to an outside diameter of lower portions of said pen holder.

4. A multicolor pen kit according to claim 2, wherein (a) a shoulder is formed on said receiving body in a region thereof joining said upper and lower portions, and (b) the open end of said pen holder seats against said shoulder when said connecting means are engaged.

5. A multicolor pen kit according to claim 4, wherein (a) said external connecting means comprises a threaded portion on said upper portions adjacent to said shoulder, (b) said internal connecting means comprises an internally threaded portion adjacent the open end of said pen holder.

6. A multicolor pen kit according to claim 1, wherein (a) the side and shape of said receiving body is suitable to be held for short term utilization of the pen unit without said pen holder.

* * * * *